US009061308B2

(12) United States Patent
Penalver Garcia

(10) Patent No.: US 9,061,308 B2
(45) Date of Patent: Jun. 23, 2015

(54) REPAINTING HEAD FOR CIRCULAR LIDS

(71) Applicant: INDUSTRIAS PENALVER, S.L., Molina de Segura (Murcia) (ES)

(72) Inventor: Jose Penalver Garcia, Molina de Segura (ES)

(73) Assignee: Industrias Penalver, S.L., Molina de Segura (Murcia) (ES)

( * ) Notice: Subject to any disclaimer, the term of this patent is extended or adjusted under 35 U.S.C. 154(b) by 316 days.

(21) Appl. No.: 13/670,725

(22) Filed: Nov. 7, 2012

(65) Prior Publication Data

US 2013/0062431 A1 Mar. 14, 2013

Related U.S. Application Data

(63) Continuation of application No. PCT/ES2011/070382, filed on May 26, 2011.

(30) Foreign Application Priority Data

Oct. 27, 2010 (ES) ..... 201031569

(51) Int. Cl.

| | |
|---|---|
| ***B05B 13/04*** | (2006.01) |
| ***B05B 15/08*** | (2006.01) |
| ***B05B 3/02*** | (2006.01) |
| *B05B 15/06* | (2006.01) |

(52) U.S. Cl.

CPC ..... *B05B 13/0421* (2013.01); *B05B 13/04* (2013.01); *B05B 15/06* (2013.01); *B05B 3/026* (2013.01); *B05B 15/08* (2013.01)

(58) Field of Classification Search

CPC .... B05B 13/04; B05B 13/0421; B05B 15/06; B05B 15/08; B05B 3/026

See application file for complete search history.

(56) References Cited

U.S. PATENT DOCUMENTS 5,164,056 A 11/1992 Loeck
6,165,266 A * 12/2000 Garcia ..... 118/305

FOREIGN PATENT DOCUMENTS

| | | |
|---|---|---|
| EP | 0 933 134 | 8/1999 |
| EP | 1 834 706 | 9/2007 |
| ES | 2 045 779 | 1/1994 |
| ES | 2 066 679 | 3/1995 |

(Continued)

OTHER PUBLICATIONS

International Search Report issued Oct. 25, 2011 in International (PCT) Application No. PCT/ES2011/070382.

*Primary Examiner* — Dah-Wei D Yuan
*Assistant Examiner* — Stephen Kitt
(74) *Attorney, Agent, or Firm* — Wenderoth, Lind & Ponack, L.L.P.

(57) ABSTRACT

The repainting head is designed to be installed on a workbench of a repainting machine for repairing circular lids. It is characterized in that it comprises a repainting device (1) moveable by means of an elevation device (2), this repainting device (1) having a main rotary shaft (13) to which are attached one/two axial shafts (18) on which are mounted one/two painting arms (19) that are constrained to rotate with the main rotary shaft (13). Each repainting arm (19) is connected to the respective painting gun (20), the distance of which from the geometric center of the main rotary shaft (13) is variable, each arm (19) rotating about the axial shaft (18), the required position of each repainting arm (19) being set using anchoring means that prevent any relative movement between the main rotary shaft (13) and the axial shaft (18).

26 Claims, 10 Drawing Sheets

(56) References Cited

FOREIGN PATENT DOCUMENTS

| | | |
|---|---|---|
| ES | 2 156 465 | 6/2001 |
| ES | 1 053 256 | 3/2003 |
| GB | 2 269 331 | 2/1994 |
| JP | 61-293644 | 12/1986 |
| WO | 99/04905 | 2/1999 |

* cited by examiner

REPAINTING HEAD FOR CIRCULAR LIDS

OBJECT OF THE INVENTION

The present invention, as expressed in the wording of this specification, relates to a repainting head for circular, easy-to-open lids in circular format from 52.5 mm to 99 mm, so that the head of the invention is capable of repairing lids in the aforementioned formats by means of a pair of painting guns capable of offering innumerable possibilities to carry out different painting applications, and a production of 600 lids per minute in one-line repainting machines and 1,200 per minute in double-line repainting machines.

The development of the present invention starts with a repainting device adapted to circular lids, integrated in a single unit, offering a fast and easy exchangeability between formats, requiring minimum maintenance, highly productive, easily adaptable to some known repainting machines and offering a broad range of possibilities to carry out the repair of the lid along diverse areas of its surface by means of the painting operation: incision, rivet, partial or full painting on either side of the lid. This device is designed to be easily implantable, both for old machines and for the newly designed machines of the same holder of the present invention, these machines having either one or two production lines.

It should be noted that, in the current market, manufacturers are being required to produce lids in shorter execution times, with a view to the final delivery of the goods, in which the finishing obtained must be optimal in order to avoid rejection during quality controls and to avoid delays in the delivery. This head is adaptable to repainting machines with one or two lines of lids and complies with both aspects, since it is highly productive and the results obtained are very satisfactory due to the broad range of possibilities offered by both painting guns.

BACKGROUND OF THE INVENTION

Currently, there are different types of repainting machines in the market designed for the repair of circular lids; however, they are normally focused on carrying out standard repainting (incision or rivet) on the lid by means of a single painting gun, and they normally never cover other, less standard painting possibilities due to the limitation of their devices. We are not aware of the existence of repainting heads with the characteristics described in this invention.

DESCRIPTION OF THE INVENTION

With the purpose of reaching the objectives and avoiding the inconveniences mentioned in the previous sections, the invention proposes a repainting head for circular lids presenting a prismatic structure provided with several activation means to carry out the repair of the respective lid by means of at least one application gun. The invention is basically constituted by two mechanisms or devices: a repainting device and an elevation device.

The repainting device is in charge of repairing the lid by means of the application of paint in a pre-established area through one/two guns. On the other hand, the elevation mechanism allows us to adjust the height of the head in order to carry out the application, as well as facilitating the cleaning and maintenance of the device.

The head is fixed to the painting workbench of the unit by means of an anchoring support provided with a rail for its adjustment. Once the head is in position, the guns applying the paint are arranged over the surface to be repaired, where a chain of fins activated by a forward and stop index drive runs longitudinally along the entire length of the painting workbench. The lids move one by one towards the painting station to be repaired by means of this mechanism, taking advantage of the stopping state of the chain, and are subsequently evacuated towards a drying oven taking advantage of the advance of said chain.

The head is activated by means of an electric motor through a belt-sheave transmission, providing movement to a main shaft where a two-way rotary gasket is coupled to supply the unit with paint or repairing fluid and air for steering. Two adjustable repainting arms are arranged on the main shaft, where two guns are coupled to carry out the process.

The elevation mechanism is based on the vertical ascending/descending movement of the repainting head with respect to the workbench of the unit, by means of a linear actuator, such as a pneumatic cylinder, located in the back part of the device. This mechanism also adjusts the suitable height at which the guns remain in respect of the painting workbench in order to carry out the application.

So, the head of the invention is characterized in that it comprises a repainting device moveable by means of an elevation device, the repainting device comprising a main rotary shaft to which at least one axial shaft is attached, on which are mounted one/two repainting arms that are constrained to rotate with the main rotary shaft. The repainting arm is connected to the respective gun, the distance of which from the geometric centre of the main rotary shaft is variable, with fixed positions though, each arm rotating around the axial shaft, the required position of each repainting arm being set using anchoring means that prevent any relative movement between the main rotary shaft and the axial shaft.

The main rotary shaft is characterized in that it is coupled to a bearing support with the interposition of bearings, said bearing support being fixed to a prismatic body, which is in turn attached to lateral mobile supports, which are attached to an upper mobile support, the lateral mobile supports being linked to a fixed support by means of a vertical guidance.

The vertical displacement of the lateral mobile supports and all other elements associated thereof, comprised by the copying device, is carried out by means of the linear actuator anchored to the fixed support.

Another characteristic of the invention is that the rod of the linear actuator is connected to a threaded orifice arranged in a cylindrical extender which is a part of the upper mobile support.

The head is also characterized in that the rotation of the main rotary shaft is transmitted by an electric motor by means of a driving sheave, a conducting sheave set on the main rotary shaft and a toothed belt.

It should be noted in the invention that the electric motor is fixed to an adjustment support, guided in a fixed motor support attached to the upper mobile support, the position of said adjustment support being set by means of a tension screw in order to tense the toothed belt.

Another particularity of the invention is that the fixed support is linked to a workbench of a repainting machine by means of an adjustable base support, fixing the repainting head set to the repainting machine.

The head is also characterized because the vertical guidance between the fixed support and the lateral mobile supports comprises linear guides screwed to the lateral mobile supports and linear bearings located in the housings of the fixed support.

Another aspect to be taken into account is that the repainting device is sealed in an airtight manner by means of a circular protection lid in the form of a lower seal, provided with rails allowing the passage towards the outside of the terminal part of the painting guns, said circular protection lid being screwed to the shafts on which the repainting arms are fixed.

Another detail of the invention is that the frontal area of the prismatic body comprises an aperture where an access registration lid for the painting guns is arranged.

A fluid transfer distribution flange is arranged from a rotary gasket to the painting guns in the upper part of the main rotary shaft, said rotary gasket being assembled on the distribution flange above such distribution flange.

It also should be noted in the invention that the fluids for repainting pass through a through orifice established in the main rotary shaft, housing conducts for the passage of the following fluids: air and paint.

It should be noted in the invention that the axial shafts are set by one of their extremities in axial orifices of the main rotary shaft, said axial orifices being equidistant from the axial geometrical centre of said main rotary shaft.

The rotary gasket is characterized in that it comprises a structure formed by a first main enveloping body, which houses the sealing elements, a second upper sealing and connecting body, a third lower body in the form of an air-tight lid and a fourth central body determined by a rotary shaft, provided with two distribution orifices for the passage of the paint and pressurized air, respectively, towards the painting guns.

Another point of the invention that should be highlighted is that the rotary shaft of the rotary gasket rotates over the two internal tracks of the bearings housed inside the main enveloping body.

The invention is also characterized in that the supply of the paint on the rotary gasket is carried out by means of an upper fitting screwed to an upper surface of the upper body, while the return of the paint remaining after the application is carried out by means of a lower fitting screwed to a lateral side of the aforementioned upper body, which is a part of the rotary gasket.

The paint flows along the interior of the rotary gasket through a first floating mechanical seal, provided with a through orifice and located inside the upper body, and a second fixed mechanical seal, arranged precisely on the upper extremity of the rotary shaft, said first floating mechanical seal being located over the second fixed mechanical seal.

Another property of the invention is that the fixed mechanical seal comprises a central housing where a screw with an internal axial orifice is housed, which is screwed on the cap of the rotary shaft, said internal axial orifice of the screw being connected to the paint distribution orifice incorporated by the rotary shaft.

In addition, the head incorporates means to secure the vertical supply at the floating mechanical seal, as well as a continuous and homogeneous contact over the fixed mechanical seal, said means comprising elastic pins and springs arranged, respectively, on blind orifices of the upper body of the rotary gasket.

Another quality of the invention is that the sealing elements of the rotary gasket are coupled on the rotary shaft and arranged around the bearings surrounding said shaft, thus constituting a solid and airtight block consisting of:

- an upper sleeve housing the extremity of the rotary shaft and the fixed mechanical seal inside;
- an upper stop, adjustable around the external diameter of the upper sleeve;
- an o-ring.

The head is also characterized because a lower sleeve, two lower stops and two o-rings are located in the lower area of the bearings housed inside the set of the rotary gasket, these elements sealing the coupling of the main enveloping body and the lower body in an airtight manner, as well as a pressurized air chamber located inside said rotary gasket.

There is a ring cavity located in the coupling between the main enveloping body and the upper body, housing the floating mechanical seal and the fixed mechanical seal, said ring cavity containing a non-stick liquid, so that the supply of the non-stick liquid towards the ring cavity is carried out by means of a perforation in the main enveloping body to which an outlet is screwed.

The sealing of the ring cavity is carried out by means of o-rings in combination with the aforementioned upper stop.

The head of the invention also includes a drainage tube for the evacuation of the accumulated compound liquid in the case of a paint leak towards the ring cavity.

Another feature of the invention is that the supply of the pressurized air in the rotary casket is carried out by means of a fixed connector screwed to the main enveloping body connected to the air chamber, at which point the distribution orifice located in the rotary shaft begins.

Lastly, it is important to highlight that, in the invention, the fixed connector is connected to a fastening support, preventing the rotation of the cylindrical structure of the rotary gasket when the rotary shaft is in operation.

Next, in order to facilitate a better comprehension of this specification and forming an integral part thereof, a set of figures representing the object of the invention in an illustrative rather than limitative manner accompany this specification.

DESCRIPTION OF THE PREFERRED EMBODIMENT

Figure 1:
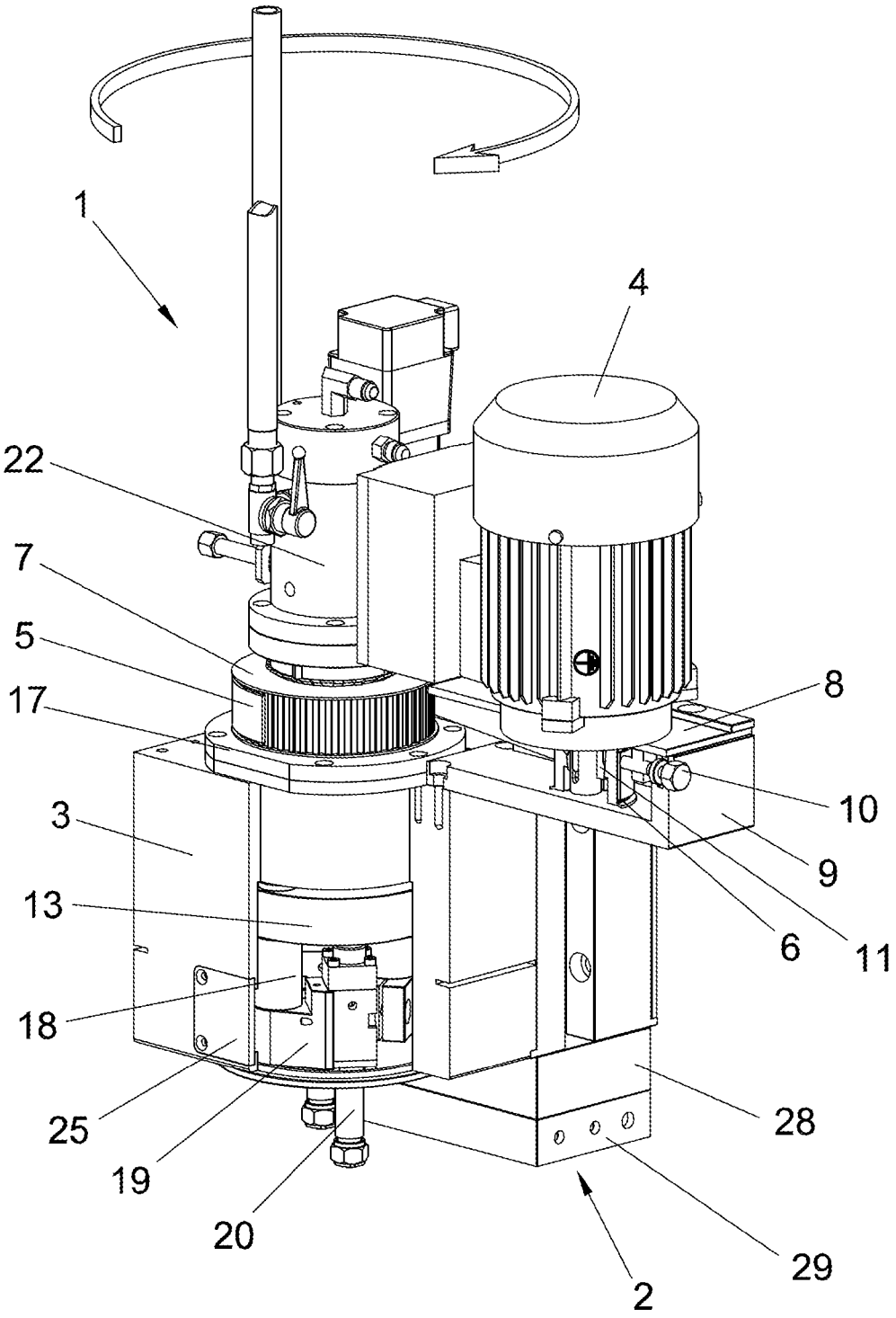
FIG. 1. Represents a general perspective view of the repainting head for circular lids object of the invention showing the main elements. The direction of the rotation of the transmission providing it with movement can also be observed.
Figure 2:
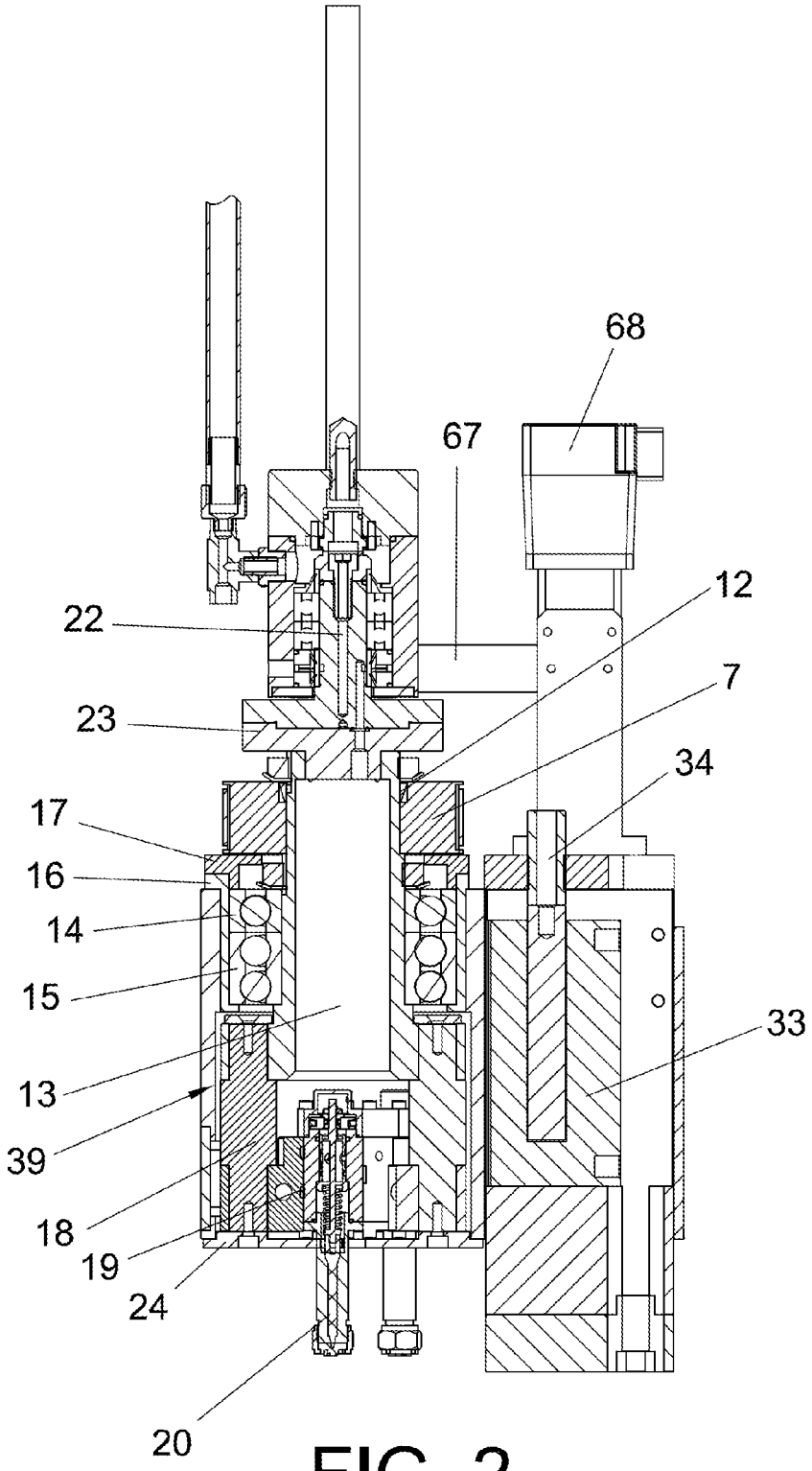
FIG. 2. Shows a transverse sectional view of a repainting device and an elevation device with all of the most representative elements.
Figure 3:
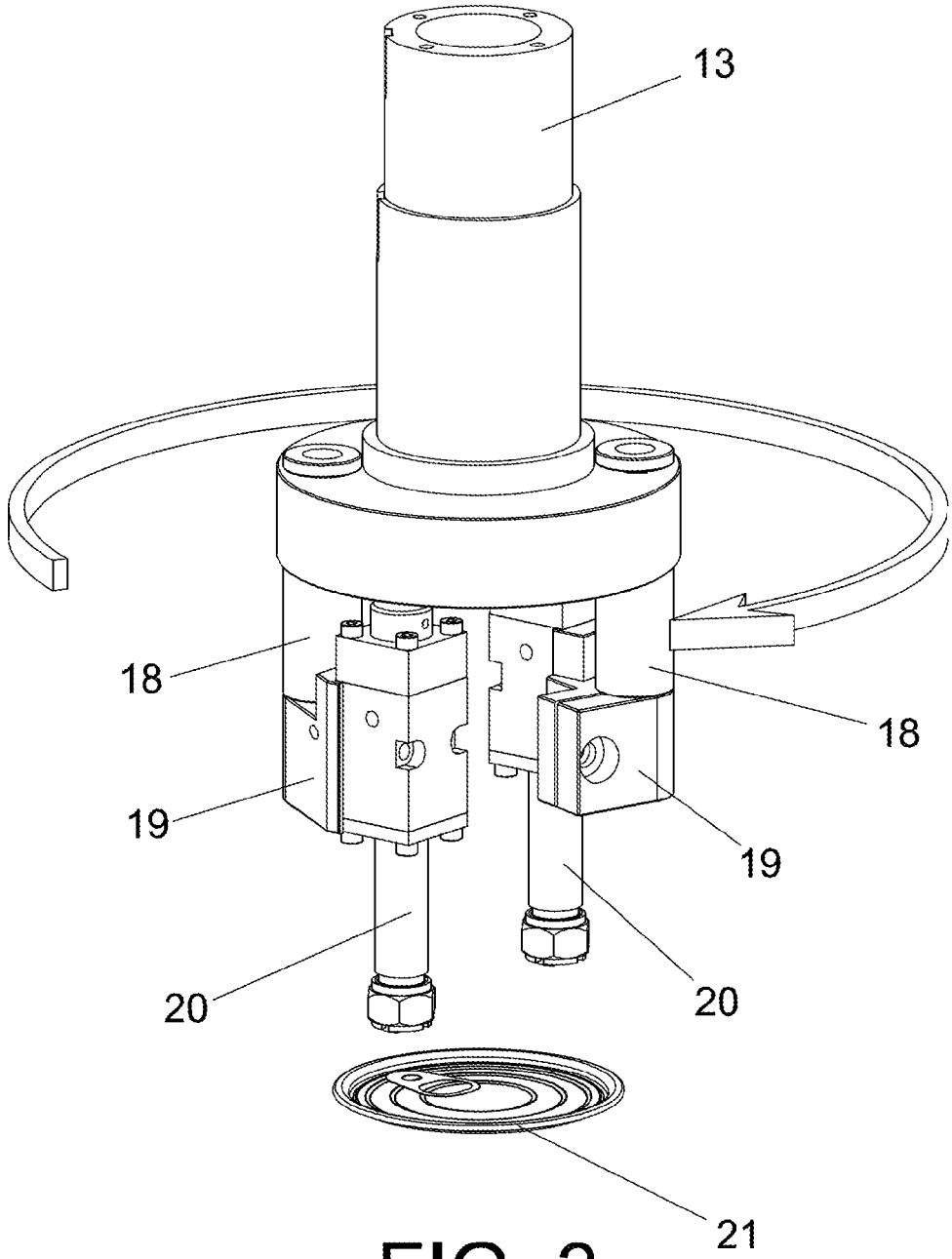
FIG. 3. Shows a perspective view of the head with the main elements intervening in the application of the repainting, from a main shaft to the paint application guns.
Figure 4A:
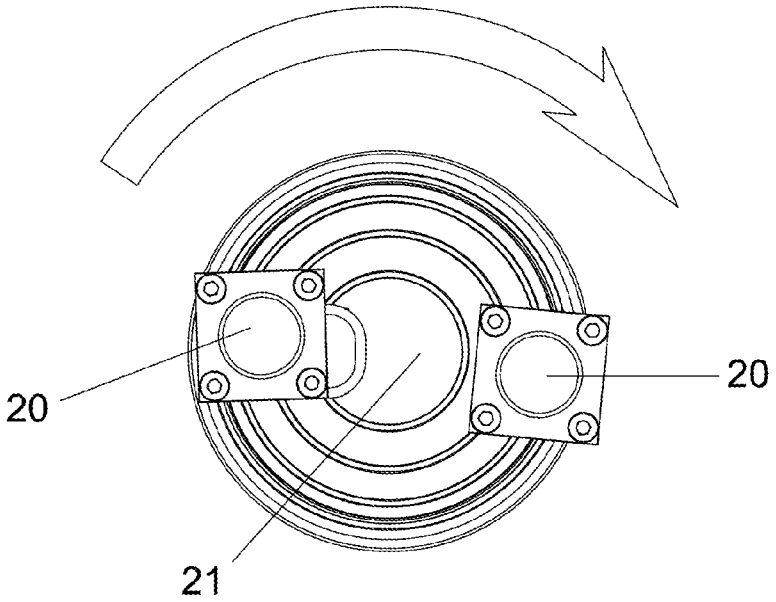
FIGS. 4*a* and 4*b*. Show plant views of the repainting process through several steps, where the progressive advance of the repainting process by means of two guns can be observed.
Figure 4B:
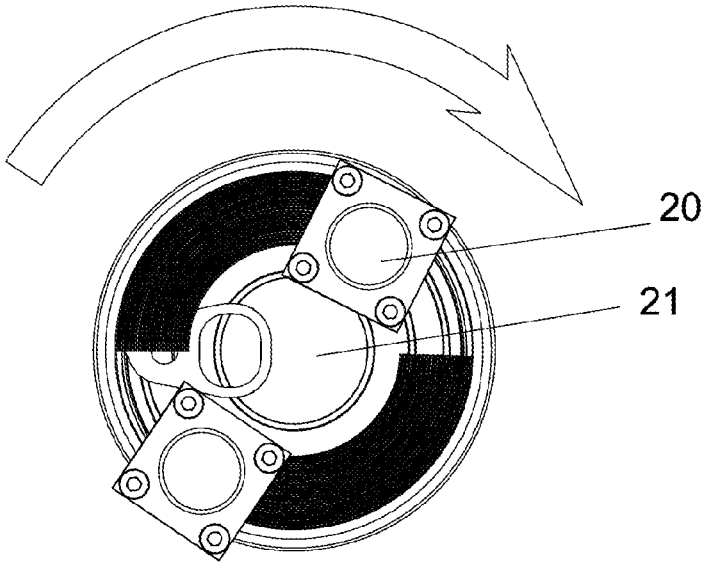
Figure 5:
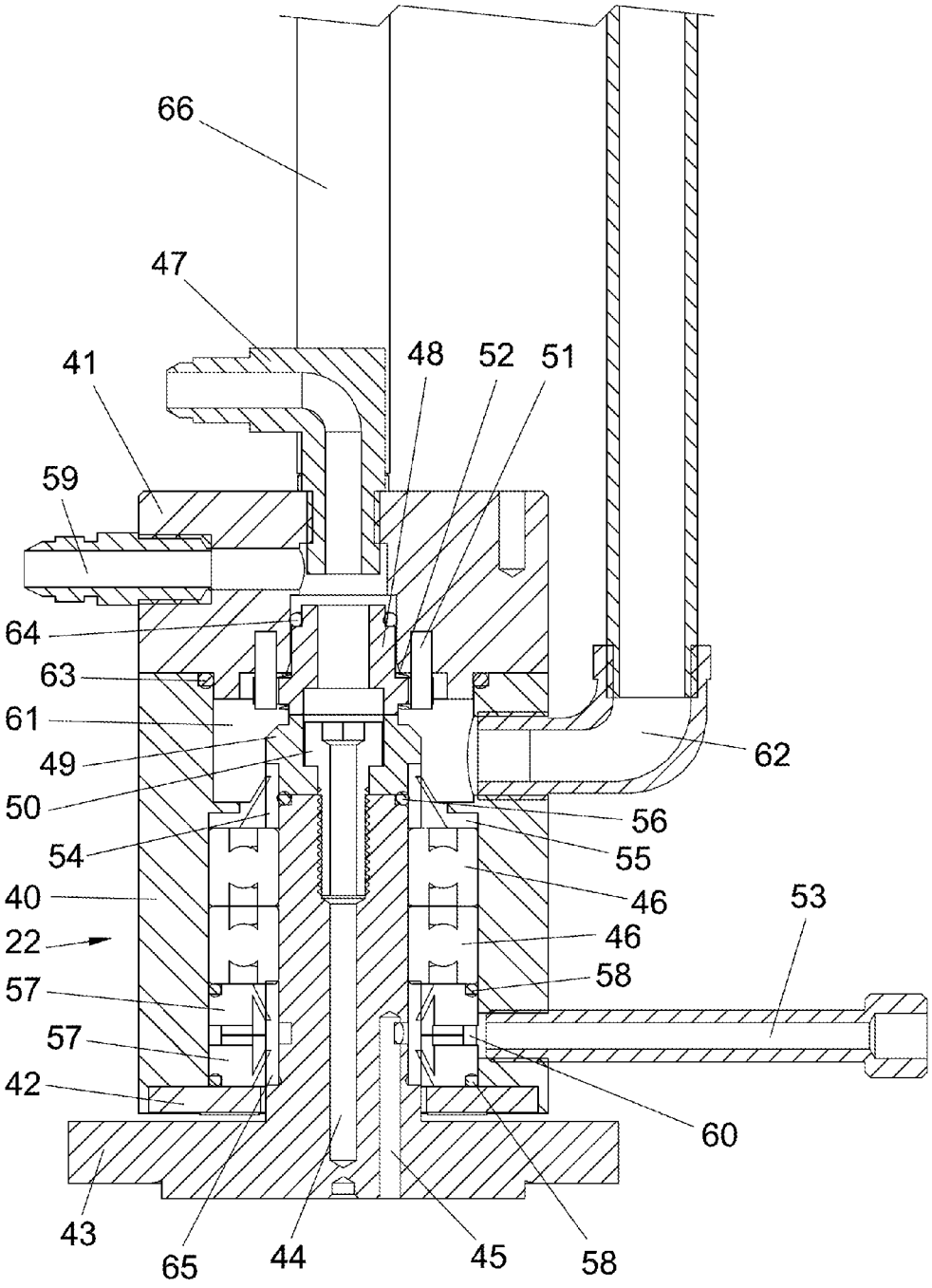
FIG. 5. Represents a sectional view of a rotary gasket with all the elements integrating said rotary gasket.
Figure 6:
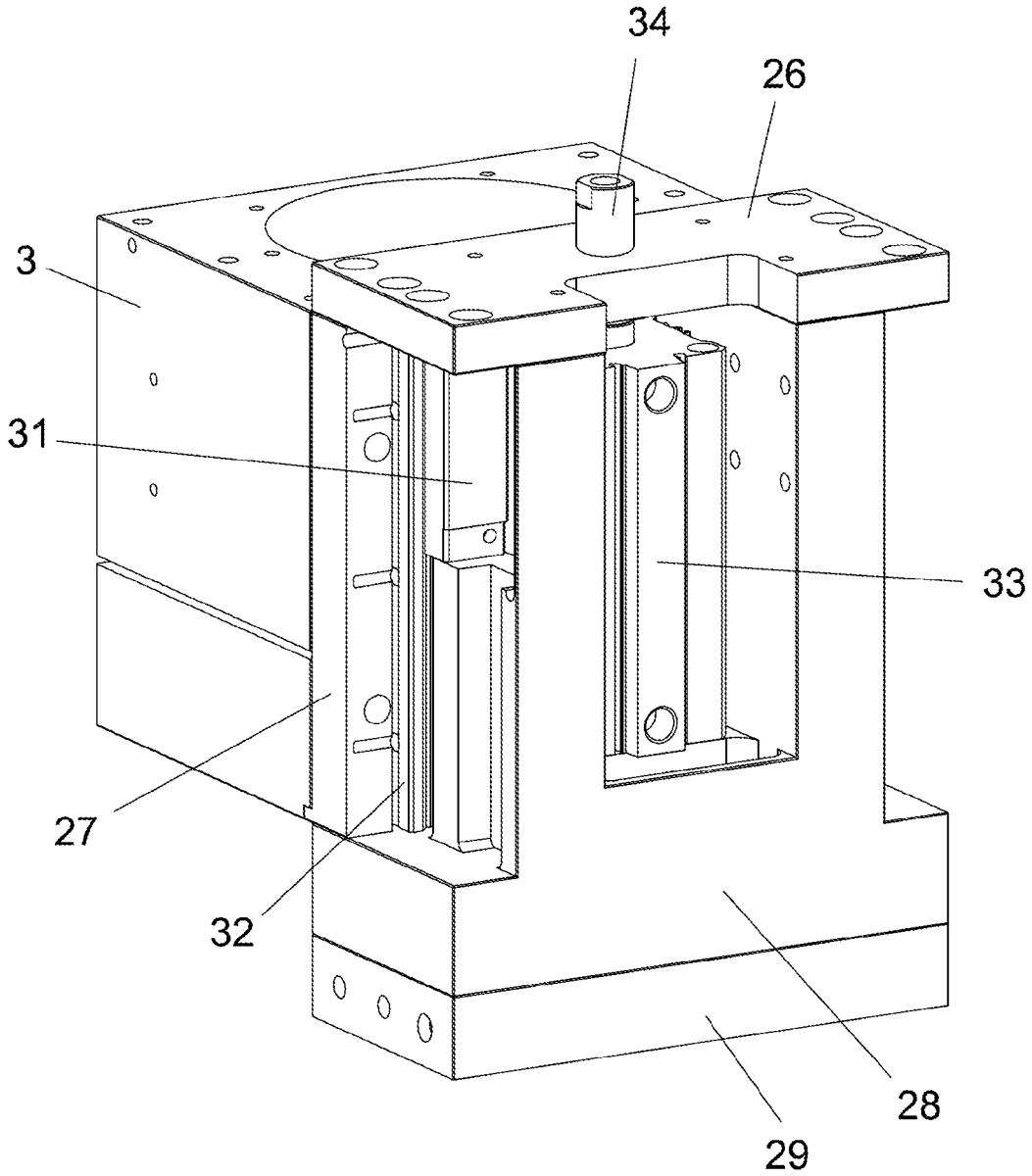
FIG. 6. Represents a perspective view of the most representative elements of the elevation device.
Figure 6A:
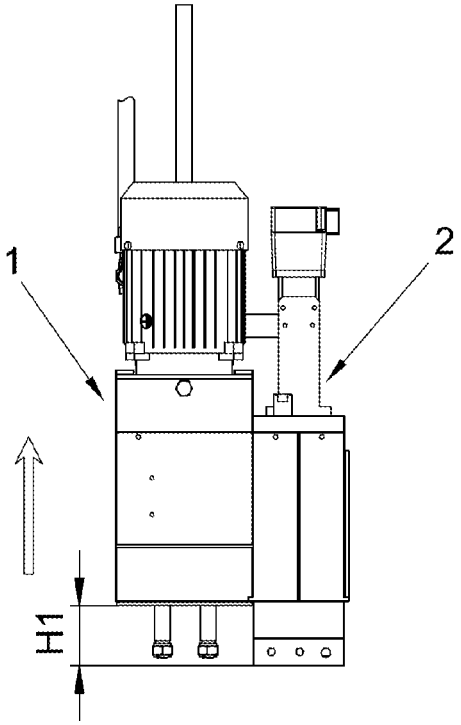
FIGS. 6*a*, 6*b* and 6*c*. Represent lateral views showing several height positions adopted by the repainting device when the elevation device is activated.
Figure 6B:
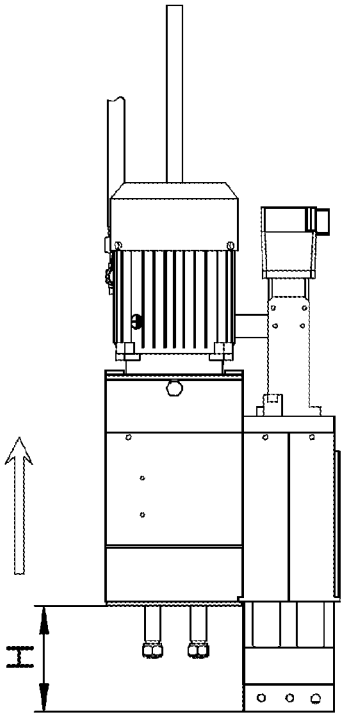
Figure 6C:
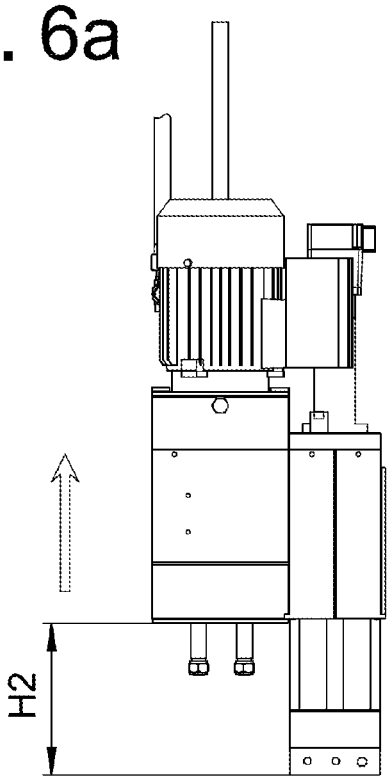
Figure 7:
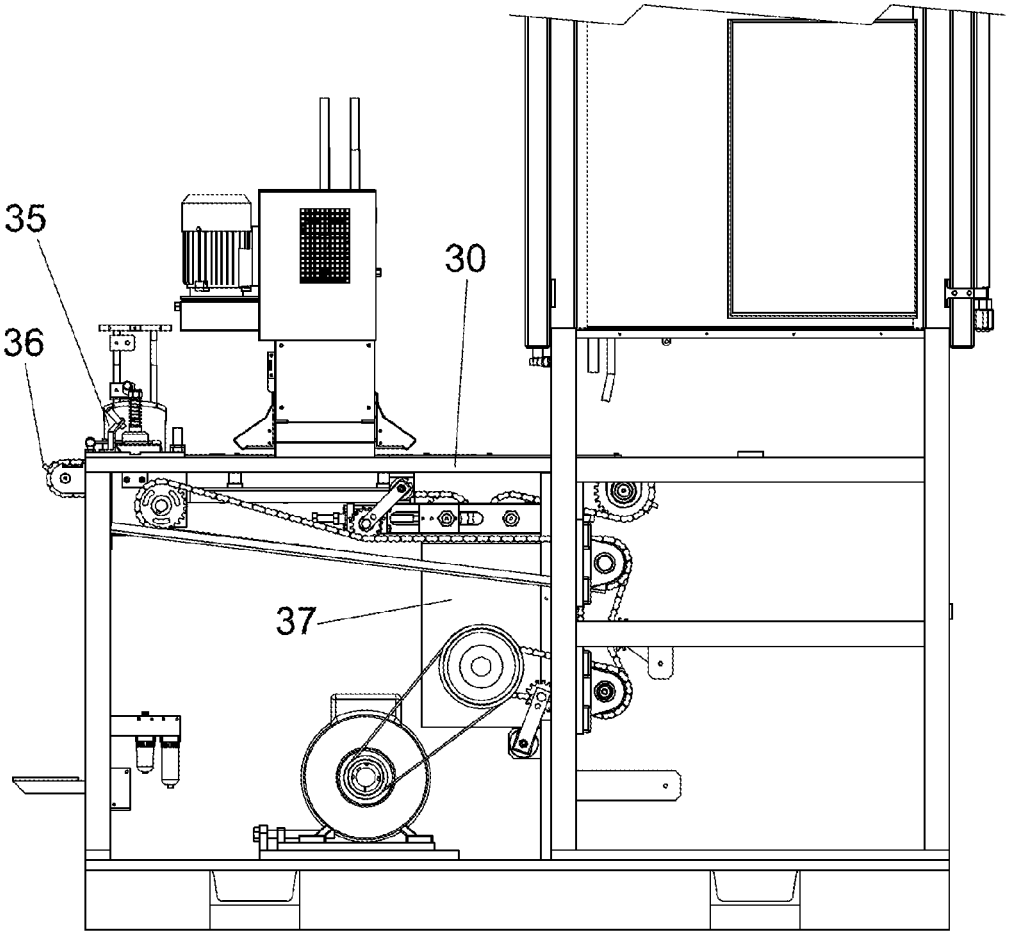
FIG. 7. Represents the implantation of the repainting head on a repainting machine by means of a lateral elevation.
Figure 8:
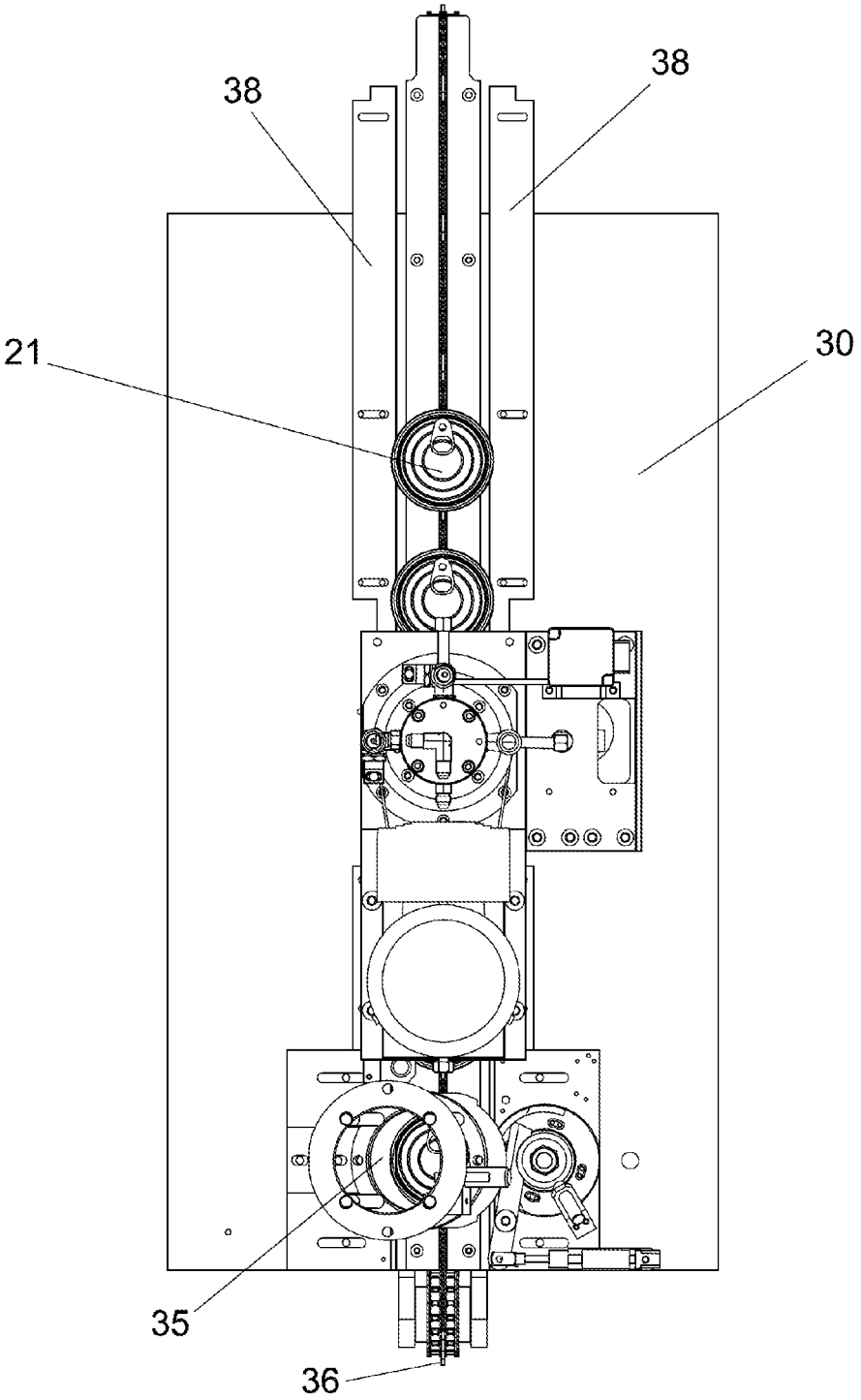
FIG. 8. Shows the implantation of the repainting head on the repainting machine with a single working line by means of a plant view.
Figure 9:
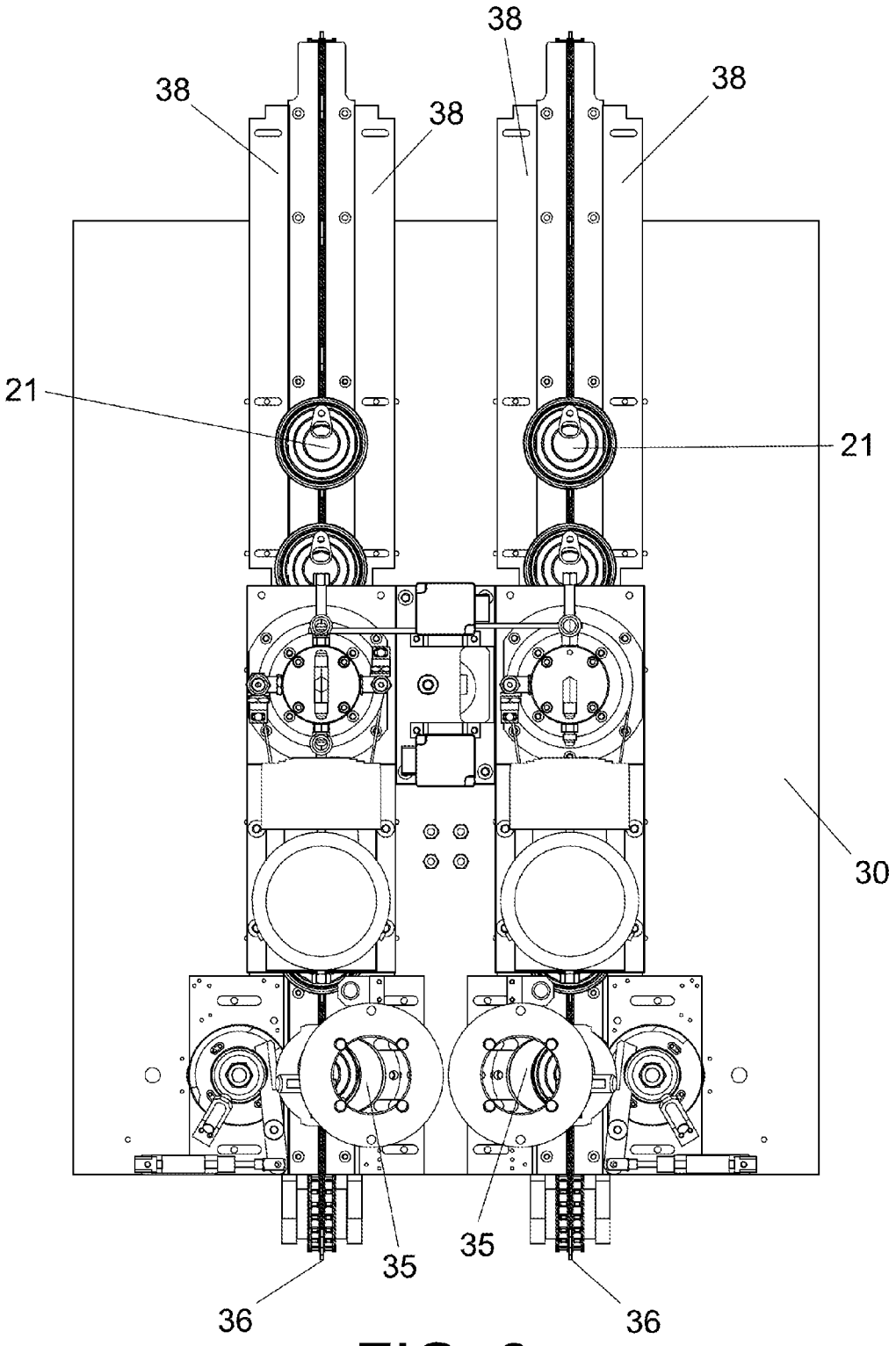
FIG. 9. Shows the implantation of the repainting head on the repainting machine with a double working line by means of a plant view.

Taking into account the numeration adopted in the figures, the repainting head for circular lids is applicable to lid formats from 52.5 mm to 99 mm in diameter, adaptable to machines existing in the market, so that different circular lid formats can be exchanged, with the particularity of not needing to adapt an additional spare part for each circular shape. The repainting head for lids is characterized in that it applies paint both on the upper side and on the lower side, from the diameter of the incision to the geometric centre of the lid, in the formats described above and based on the arrangement of two application guns, capable of covering any pre-established painting area on the lid to be repaired.

As mentioned above, regarding the head for circular lids, we will distinguish two devices within the said head for circular lids: a repainting device 1 and another elevation device 2.

The repainting device 1 is housed inside an aluminium prismatic body 3 and is annexed to the elevation device 2 by being fixed by four screws. The mechanism to carry out the repainting function is activated by means of an electric motor 4 through a transmission composed by a toothed belt 5, a driving sheave 6 and a conducting sheave 7.

In order to provide the transmission belt 5 with an optimal tension, the electric motor 4 rests on an adjustment support 8 provided with a rail, which is arranged precisely above the aforementioned fixed motor support 9, which houses the driving transmission mechanism and has a housing where a tension screw 10 is set, screwing its extremity on the adjustment support 8, allowing its displacement over the fixed motor support 9 and thus being able to tense and slacken the transmission of the belt.

The driving sheave 6 is presented coupled on the shaft of the motor 4 by means of a conical sleeve 11, while the conducting sheave 7 is fixed by means of a sleeve 12 and is located in the upper extremity of a main rotary shaft 13, which is housed inside a cylindrical through orifice presented by the prismatic body 3 in its central zone.

With these premises, the main rotary shaft 13 is constrained to rotate on the internal tracks of two ball bearings 14-15 housed inside a bearing support 16, provided with an upper lid 17, which is located in the cylindrical orifice presented by the prismatic body 3 for that purpose. The lower extremity of the main rotary shaft 13 has been dimensioned over a diameter larger than its opposite extremity in order to house two axial orifices with an angular offset of 180° between them, where two axial shafts 18 are assembled in order to locate two repainting arms 19, which are constrained to rotate with the main rotary shaft 13.

The axial shafts 18 do not rotate around their symmetry shaft due to being blocked by a clamping washer rendering them immobile. This way, the repainting arms 19 are fixed to both axial shafts 18 on the lower extremity of the shafts by means of two screws, and two painting guns 20, activated by means of an electrovalve 68, are coupled on said repainting arms 19, for the application of paint on the lid 21 by means of projection.

In order to obtain the different painting diameters, we must loosen the two screws fixating the painting arms 19 to the shafts 18 and we will turn both arms 19 towards the geometric centre of the head, thus bringing the two application guns closer until they meet each other.

With this arrangement increasingly smaller painting diameters are described. Otherwise, if the painting arms 19 are turned from the centre of the head towards the outside, increasingly larger painting diameters are obtained, thus covering lid formats which can be comprised between 52.5 mm to 99 mm.

Each painting gun can describe different diameters with the purpose of protecting different areas of the lid.

In order for the painting guns 20 to perform their function over the areas of the lid 21 to be painted, they need to be supplied with paint and pressurized air. This is achieved by means of a rotary gasket 22, which has been designed for the supply and distribution of both fluids towards the painting guns 20. Said rotary gasket is basically composed by a cylindrical aluminium structure, assembled by means of three bodies 40-41-42 screwed to each other and to a rotary shaft 43. We can distinguish the following elements in the cylindrical body: a main enveloping body 40 housing the main sealing elements of the device, an upper body 41 acting as a seal and a connection in that zone, and lastly, a lower body 42 in the form of a lid sealing the cylindrical body in an airtight manner. The rotary shaft 43 has two distribution orifices 44-45 for the passage of the paint and pressurized air towards the painting guns 20, and rotates on the two internal tracks of two ball bearings 46 housed inside the main enveloping body 40. The paint supply on the rotary gasket 22 is carried out by means of an upper fitting 47 screwed to the upper surface of the body 41, while the return of the paint remaining after the application is carried out by means of a lower fitting 59. This way, the paint flows through two mechanical seals 48-49, where one of them is floating 48, provided with a through orifice and located inside the upper body 41, and the other is fixed 49, and is arranged precisely in the upper extremity of the rotary shaft 43. The fixed mechanical seal 49 presents a central housing where a screw 50 with an internal axial orifice screwed on the cap of the rotary shaft 43 is housed, which is connected to the paint distribution orifice 44 presented inside the shaft 43. With this arrangement, this one is referred to as a fixed mechanical seal 49 by being screwed to the rotary shaft 43 by means of the screw 50, and the other is referred to as a floating mechanical seal 48 by being in contact with the upper surface of the fixed seal 49, making small axial displacements during the rotation of the fixed seal 49 in some occasions as a consequence of the foregoing. In order to ensure the vertical alignment in the device of the floating seal 48, as well as a permanent and homogenous contact on the fixed seal 49, two and four blind orifices, where two elastic pins 51 and four springs 52 are located, have been arranged respectively in the upper body 41. The main set of sealing elements in the rotary gasket 22 are coupled on the rotary shaft 43 and arranged around the two bearings 46 so that all of them make up a solid and airtight block consisting of: an upper sleeve 54 housing the extremity of the rotary shaft 43 and the fixed mechanical seal 49 inside, an upper stop 55, adjustable around the external diameter of the supper sleeve 54, an o-ring 56. In the area below the bearings 46, a lower sleeve 65, two lower stops 57 and two o-rings 58 are located in such a way that they seal the coupling of the main body 40 and the lower body 42 in an airtight manner, as well as a pressurized air chamber 60 located inside the rotary gasket 22.

On the other hand, in the design of the coupling of the main body 40 and the upper body 41, a ring cavity 61 has been created, where the mechanical seals 48-49 are housed and a non-stick liquid is deposited, whose main function is to prevent the solidification of the paint inside the ring cavity 61 in the case of potential leaks. In order to facilitate the supply of this fluid towards the cavity 61, the main enveloping body 40 has been provided with an orifice, to which an outlet 62 is screwed. The sealing of the ring cavity 61 is carried out by means of the o-rings 63 and 64 and the upper stop 55. In the case of a paint leak to the ring cavity 61, the evacuation of the accumulated compound liquid will be carried out by means of a drainage tube 66. The supply of pressurized air in the rotary gasket 22 is carried out by means of a fixed connector 53 which is screwed to the main enveloping body 40 and is connected to the air chamber 60. Due to the pressure created in said air chamber 60, the air passes to the distribution orifice 45 presented in the rotary shaft 43. This fixed connector 53, in its static condition due to it being fixed on a fastening support 67, prevents the rotation of the cylindrical structure of the rotary gasket 22 when the rotary shaft 43 is in operation.

In order to facilitate the transfer of fluids from a rotary gasket 22 to the painting guns 20, a distribution flange 23 has been coupled on the upper extremity of the main rotary shaft 13. For this reason, the main rotary shaft 13 has been designed to include a through hole in its interior where four conducts (two for the supply of paint and two for the supply of pressurized air for each gun) and their corresponding fittings, in order to cause both fluids to arrive to the application area.

In order to seal the repainting device 1 in an airtight manner from the paint projections generated during the application, a circular protection lid 24 has been arranged in the form of a seal, provided with two rails allowing the passage of the protruding body of the painting gun 20 towards the outside of the head. Likewise, a rectangular aperture has been designed in the frontal area of the prismatic body 3, provided with a registration lid 25 for the access of the painting guns 20, facilitating the assembly/maintenance tasks of the same with it.

The results obtained with this copying system are highly satisfactory, because by means of a simple adjustment process we can guarantee a suitable and precise application of paint, adapted to the theoretical diameter required by the format of the lid in question. In addition, we save on the inclusion of additional specific pieces for each type of lid type with this painting system, due to which the so-called format change is reduced simply to the manual adjustment of both guns to the pre-established diameter.

It should be noted that the repainting device is practically exempt from maintenance in terms of lubrication, since the bearings 14-15 incorporated are permanently lubricated.

The elevation device 2 is constituted by four elements: three of them are mobile and one of them is fixed. The three mobile elements are screwed to each other, forming a connected body and arranged 90° between them, so that one of them is located in a horizontal arrangement, the so-called upper mobile support 26, while the other two bodies, known as lateral mobile supports 27, are arranged vertically.

The mobile lateral supports 27 are presented screwed on the prismatic body 3, which includes the repainting device 1, and on the upper mobile support 26, so that when the former is elevated, it displaces the lateral mobile supports 27 vertically and drags the entire repainting device 1 at the same time by being the three elements fixed to one another.

The elevation device 2 moves around a fixed support 28, provided with an adjustable base support 29 in its lower base, fixing the entire repainting head on the workbench 30 of a repainting machine. Two housings have been mechanized on the fixed support 28 for the coupling of linear bearings 31, which are fixed to said body by means of screws, and linear guides 32, screwed to each one of the lateral mobile supports 27 which slide vertically on said bearings, providing these elements with movement.

In order to carry out the elevation of the repainting head, a linear actuator has been included, such as a compact pneumatic cylinder 33, which is screwed on the base of the fixed support 28. When the cylinder 33 is provided with air pressure, its rod moves the upper mobile support 26 vertically, thus elevating the entire repainting device 1 to the desired position. In order to ensure a uniform thrust of the cylinder 33 to the upper mobile support 26, a cylindrical extender 34, located in the extremity of the rod and screwed on a threaded orifice incorporated in the cylindrical extender 34 connected to the upper mobile support 26, has been designed.

The repainting device 1 and the elevation device 2 are both implanted on the repainting machine and located in the central part of the repainting bench 30. The supply is carried out by means of a supply tower 35 designed for the correct distribution of lids 21 to the unit. Once the lids 21 have been placed on supply guides 38, a fin chain 36, activated by an index drive 37 coordinating the forward and stop movement, locates one of the lids 21 in the repainting position, and the repair of the corresponding lid 21 is carried out by means of the coupling of the painting guns 20. After this operation takes place, the fin chain 36 moves the lids 21 to the interior of a drying oven.

The invention claimed is:

1. Repainting head for circular lids, designed to be installed on a horizontal platform in the form of a workbench of a repainting machine for repairing lids, which are dragged by a mechanism under the repainting head, which also includes means to provide the repainting materials, paints and pressurized air by painting guns, said repainting head comprising a repainting device (1), moveable by an elevation device (2), said repainting device (1) comprising:

a main rotary shaft (13), at least one axial shaft (18) being coupled to the main rotary shaft (13), at least one repainting arm (19) being assembled to the at least one axial shaft (18), said at least one axial shaft (18) being constrained to rotate with the main rotary shaft (13);

the at least one repainting arm (19) being connected to the respective painting gun (20), whose distance to a geometrical center of the main rotary shaft (13) is variable by rotating said at least one repainting arm (19) around the at least one axial shaft (18);

a desired position of the at least one repainting arm (19) being set through an anchoring arrangement that prevents any relative movement between the main rotary shaft (13) and the at least one axial shaft (18);

the means to provide the repainting materials comprising a rotary structure (22) arranged above the main rotary shaft (13);

wherein the main rotary shaft (13) is coupled to bearings (14-15), located inside housings (16) of a bearing support which is fixed to a prismatic body (3), which is in turn attached to lateral mobile supports (27) and the lateral mobile supports (27) are attached to an upper mobile support (26), with the lateral mobile supports (27) being linked to a fixed support (28) by a vertical guide; and wherein vertical displacement of the lateral mobile supports (27) and all other elements associated to said lateral mobile supports (27) comprised by the repainting device, is carried out by a linear actuator (33) anchored to the fixed support (28).

2. Repainting head for circular lids according to claim 1, wherein a rod of the linear actuator (33) connects to a threaded orifice of a cylindrical extender (34), which is a part of the upper mobile support (26).

3. Repainting head for circular lids according to claim 1, wherein rotation of the main rotary shaft (13) is transmitted from an electric motor (4) through a driving sheave (6), a conducting sheave (7) set on the main rotary shaft (13) and a toothed belt (5).

4. Repainting head for circular lids according to claim 1, wherein the rotation of the main rotary shaft (13) is transmitted from an electric motor (4) through a driving sheave (6), a conducting sheave (7) set on the main rotary shaft (13) and a toothed belt (5); and the electrical motor (4) is fixed to an adjustment support (8), guided in a fixed motor support (9) attached to the upper mobile support (26), the position of said adjustment support (8) being set via a tension screw (10) in order to tense the toothed belt (5).

5. Repainting head for circular lids according to claim 1, wherein the fixed support (28) is linked to a workbench (30) of a repainting machine by an adjustable base support (29), fixing the repainting head set on the repainting machine.

6. Repainting head for circular lids according to claim 1, wherein the vertical guidance guide between the fixed support (28) and the lateral mobile supports (27) comprises linear guides (32) screwed to the lateral mobile supports (27), and linear bearings (31) located in housings of the fixed support (28).

7. Repainting head for circular lids according to claim 1, wherein the repainting device is sealed in an airtight manner by a circular protection lid (24) in the form of a lower seal, provided with rails allowing the passage towards the outside of the terminal part of the painting guns (20), being said circular protection lid (24) screwed to the at least one shaft on which the at least one repainting arm (19) is fixed.

8. Repainting head for circular lids according to claim 1, wherein a frontal zone of the prismatic body (3) comprises an aperture where an access registration lid (25) for the painting guns (20) is arranged.

9. Repainting head for circular lids according to claim 1, wherein a fluid transfer distribution flange (23) is arranged from the rotary structure (22) to the painting guns (20) in the upper part of the main rotary shaft (13), said rotary structure (22) being assembled on the distribution flange (23) above said distribution flange (23).

10. Repainting head for circular lids according to claim 9, wherein the fluids for repainting pass through a through orifice established in the main rotary shaft (13), housing conduits for the passage of air and paint.

11. Repainting head for circular lids according to claim 1, wherein the at least one axial shaft comprises a plurality of axial shafts (18) that are set by one of their extremities in axial orifices (39) of the main rotary shaft (13), said axial orifices (39) being equidistant from the axial geometrical centre center of said main rotary shaft (13).

12. Repainting head for circular lids, designed to be installed on a horizontal platform in the form of a workbench of a repainting machine for repairing lids, which are dragged by a mechanism under the repainting head, which also includes means to provide the repainting materials, paints and pressurized air by painting guns, said repainting head comprising a repainting device (1), moveable by an elevation device, said repainting device (1) comprising:

a main rotary shaft (13), at least one axial shaft (18) being coupled to the main rotary shaft (13), and at least one repainting arm (19) being assembled to the at least one axial shaft (18), said at least one axial shaft (18) being constrained to rotate with the main rotary shaft (13);

the at least one repainting arm (19) being connected to the respective painting gun (20) whose distance to a geometrical center of the main rotary shaft (13) is variable by rotating said at least one repainting arm (19) around the at least one axial shaft (18);

a desired position of the at least one repainting arm (19) being set through an anchoring arrangement that prevents any relative movement between the main rotary shaft (13) and the at least one axial shaft (18);

the means to provide the repainting materials comprising a rotary structure (22) arranged above the main rotary shaft (13);

wherein the main rotary shaft (13) is coupled to bearings (14-15), located inside housings (16) of a bearing support which is fixed to a prismatic body (3), which is in turn attached to lateral mobile supports (27) and the lateral mobile supports (27) are attached to an upper mobile support (26), with the lateral mobile supports (27) being linked to a fixed support (28) by a vertical guide; and wherein the rotary structure (22) is formed by a main enveloping body (40), which houses the sealing elements, a second upper sealing and connecting body (41), a third lower body (42) in the form of an air-tight lid and a central body comprised of a second rotary shaft (43), provided with two distribution orifices (44-45) for the passage of the paint and pressurized air, respectively, towards the painting guns (20).

13. Repainting head for circular lids according to claim 12, wherein the second rotary shaft (43) of the rotary structure (22) rotates over two internal tracks of the bearings (46) housed inside the main enveloping body (40).

14. Repainting head for circular lids according to claim 12, wherein supply of paint on the rotary structure (22) is carried out by via an upper fitting (47) screwed to an upper surface of the upper body (41), while return of the paint remaining after the application is carried out by via a lower fitting (59) screwed to a lateral side of the upper body (41), which is a part of the rotary structure (22).

15. Repainting head for circular lids according to claim 12, wherein the paint flows along the interior of the rotary structure (22) through a first floating mechanical seal (48), provided with a through orifice and located inside the upper body (41), and a second fixed mechanical seal (49), arranged precisely on the upper extremity of the second rotary shaft (43), said first floating mechanical seal (48) being located over the second fixed mechanical seal (49).

16. Repainting head for circular lids according to claim 15, wherein the fixed mechanical seal (49) comprises a central housing where a screw (50) with an internal axial orifice is housed, which is screwed on a cap of the second rotary shaft (43), said internal axial orifice of the screw (50) being connected to the paint distribution orifice (44) incorporated by the second rotary shaft (43).

17. Repainting head for circular lids according to claim 15, further including a vertical alignment configuration to ensure vertical alignment of the floating mechanical seal (48) and a continuous and homogeneous contact of the floating mechanical seal (48) over the fixed mechanical seal (49), said vertical alignment configuration comprising elastic pins (51) and springs (52) arranged on blind orifices of the upper body (41) of the rotary structure (22).

18. Repainting head for circular lids according to claim 12, wherein the sealing elements of the rotary structure (22) are coupled on the second rotary shaft (43) and arranged around the bearings (46) surrounding said shaft, thus constituting a solid and airtight block comprising:

an upper sleeve (54) housing the extremity of the second rotary shaft (43) and a fixed mechanical seal (49) inside;

an upper stop (55), adjustable around an external diameter of the upper sleeve (54); and an o-ring (56).

19. Repainting head for circular lids according to claim 18, wherein a lower sleeve (65), two lower stops (57) and two o-rings (58) are located in a lower area of the bearings (46) housed inside the set of the rotary structure (22), these elements sealing the coupling of the main enveloping body (40) and the lower body (42) in an airtight manner, as well as a pressurized air chamber (60) located inside said rotary structure (22).

20. Repainting head for circular lids according to claim 15, wherein there is a ring cavity (61) is located in the coupling between the main enveloping body (40) and the upper body (41), where the floating mechanical seal (48) and the fixed mechanical seal (49) are housed, said ring cavity (61) containing a non-stick liquid.

21. Repainting head for circular lids according to claim 20, wherein supply of the non-stick liquid towards the ring cavity (61) is carried out via a perforation in the main enveloping body (40) to which an outlet (62) is screwed.

22. Repainting head for circular lids according to claim 20, wherein the sealing of the ring cavity (61) is carried out by o-rings (63-64) in combination with an upper stop (55).

23. Repainting head for circular lids according to claim 20, further comprising a drainage tube (66) for evacuation of accumulated compound liquid in case of a leak of the paint towards the ring cavity (61).

24. Repainting head for circular lids according to claim 20, wherein supply of the pressurized air in the rotary structure (22) is carried out by a fixed connector (53) screwed to the main enveloping body (40) connected to an air chamber (60).

25. Repainting head for circular lids according to claim 24, wherein the distribution orifice (45) located in the second rotary shaft (43) begins at the air chamber (60).

26. Repainting head for circular lids according to claim 24, wherein the fixed connector (53) is connected to a fastening support (67), preventing rotation of a cylindrical structure of the rotary structure (22) when the second rotary shaft (43) is in operation.

* * * * *